US006612716B2

(12) United States Patent
Kwak

(10) Patent No.: US 6,612,716 B2
(45) Date of Patent: Sep. 2, 2003

(54) FLASHLIGHT

(76) Inventor: Jeong-Kook Kwak, 203-702 Hyundai Hometown 2-danji, 19-4 Kaibong-dong 480, Kuro-gu, Seoul 152-090 (KR)

( * ) Notice: Subject to any disclaimer, the term of this patent is extended or adjusted under 35 U.S.C. 154(b) by 0 days.

(21) Appl. No.: 10/058,810

(22) Filed: Jan. 30, 2002

(65) Prior Publication Data

US 2003/0142491 A1 Jul. 31, 2003

(51) Int. Cl.[7] ..... F21L 4/04
(52) U.S. Cl. ..... 362/205; 362/202
(58) Field of Search ..... 362/202, 205, 362/208, 329, 394, 395

(56) References Cited

U.S. PATENT DOCUMENTS

| | | | | |
|---|---|---|---|---|
| 1,361,920 A | * | 12/1920 | Spiers | 362/205 |
| 1,376,976 A | * | 5/1921 | Smalley | 362/205 |
| 4,951,183 A | * | 8/1990 | Wang | 362/202 |
| 5,331,528 A | * | 7/1994 | Chen | 362/205 |
| 5,426,273 A | * | 6/1995 | Shiau | 362/205 |

* cited by examiner

*Primary Examiner*—Alan Cariaso
(74) *Attorney, Agent, or Firm*—Dennison, Schultz & Dougherty

(57) ABSTRACT

A flashlight in which a switch main body may be easily assembled by fitting parts for a top surface of the switch main body to be pushed upwardly for automatically and closely contacting an inside of the flashlight without using any additional element, and a lens is closely fixed to a reflection mirror of a head part so that the vibration may be prevented and the waterproof effect may be obtained, thereby improving the productivity and the reliability of the products. In the flashlight, a switch cover of the switch main body is integrally formed with a semicircular insertion plate, an upper body is formed with cut parts at both sides for matching an insertion plate of the switch main body with the cut parts, so that the insertion plate is inserted along the cut parts as a force is applied to the insertion plate, thereby simply assembling the switch main body into the flashlight. As the insertion plate pushes upper parts of the cut parts outwardly, the switch main body is closely contacting an inside of a case and fixed in the case without any additional elements, wherein a negative terminal of the switch main body is protruded outwardly to contact the case.

4 Claims, 3 Drawing Sheets

FLASHLIGHT

BACKGROUND OF THE INVENTION (a) Field of the Invention

The present invention relates to a flashlight, and more particularly to, a flashlight which a switch main body may be easily assembled by fitting parts to be pushed upwardly for automatically and closely contacting an inside of the flashlight, and a lens is closely fixed to a reflection mirror of a head part so that the vibration may be prevented and the waterproof effect may be obtained, thereby improving the productivity and the reliability of the products.

(b) Description of the Related Art

In general, a flashlight is constructed comfortably to carry and utilizes batteries for power supply. The flashlight includes a switch for turning on or off the power supply of the batteries to light a bulb.

In the flashlight, it is impossible to figure out a consumption amount of the batteries so that a user has to prepare spare batteries in advance. In order to resolve the above inconvenience, a flashlight indicating the battery consumption has been suggested.

The conventional flashlight is, however, complicated in the structure particularly in the switch part, so that the assembling of the switch part is difficult, increasing the assembling procedure, thereby increasing the manufacturing cost and decreasing the productivities.

SUMMARY OF THE INVENTION

Therefore, the present invention is derived to resolve the above problems of the prior art and has an object to provide a flashlight in which the structure of a switch main body is simplified to be assembled by fitting parts and the switch main body closely contacts an inside of the flashlight by a top surface of the switch main body which lifts automatically, thereby improving the productivity and the reliability of the products.

It is another object of the present invention to provide a flashlight in which a lens is simply inserted and firmly fixed into a reflection mirror assembled into a head part of the flashlight, thereby obtaining the vibration prevention and the waterproof effect.

It is a further object of the present invention to provide a flashlight in which a negative terminal is protruded to a side of the switch main body to automatically contact an inside of the flashlight case.

In order to achieve the above and other advantages and in accordance with the purpose of the present invention, an embodied and broadly described, a flashlight includes a head part for inserting and fixing a bulb, a reflection mirror and a lens, a switch main body for carrying out switching to turn on or off a power supply with respect to that bulb, a cylindrical case for receiving and fixing the head part and the switch main body inside, and a lid elastically mounted with a spring for compressing and fixing batteries to be incorporated in the case.

According to the present invention, the flashlight is characterized in that the switch main body includes a semi-cylindrical switch cover and a body part coupled with the switch cover, wherein the switch cover has a circular bulb securing part to which a bulb is secured, a semicircular insertion plate formed at a rear surface of the securing part, and a protection part integrally formed with a lower part of the insertion plate for surrounding the body part, and the body part includes an upper body, a lower body, a button part positioned between the upper body and the lower body, and terminal parts.

According to the present invention, the upper body is formed with a bulb fixing part to which the bulb is fixed, a hole for inserting the button, and cut parts at both sides for inserting and fixing the insertion plate of the switch cover, and the lower body is formed with a terminal securing part to which positive and negative terminals are fixed, and a plurality of fixing grooves for fixing the positive and negative terminals and the button.

In the present invention, a protrusion part of the lens is inserted and fixed in the reflection mirror that is coupled in the head part, wherein a protrusion formed outside the lens is pressed when coupling the lens in the head part.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

The present invention will be explained in more detail with reference to preferred embodiments in junctions with the attached drawings.

Figure 1:
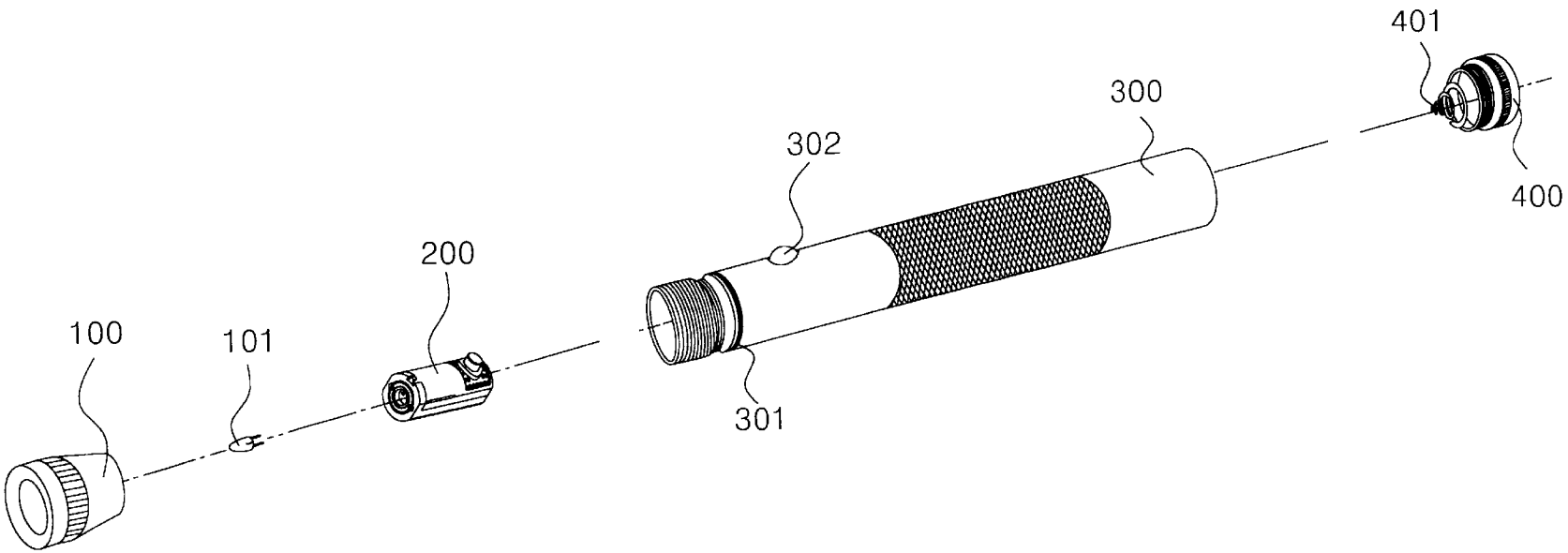
FIG. 1 is a perspective view of a disassembled flashlight according to the present invention.

FIG. 1 is a perspective of a flashlight according to the present invention. In FIG. 1, the flashlight includes a head part 100 for inserting and fixing a bulb 101 and a reflection mirror, a switch main body 200 for carrying out switching to turn on or off a power supply with respect to the bulb, a cylindrical case 300 for inserting and fixing the head part 100 and the switch main body 200, and a lid 400 elastically mounted with a spring 401 for compressing and fixing batteries to be incorporated in the case.

In the attached drawings, a reference symbol 301 which has not been explained above is a circular rubber ring to be fixed outside the case for waterproofing when the case is coupled with the head part, and a reference symbol 301 is a rubber cover to be coupled with a button of the switch main body 200 via a hole for waterproofing.

Figure 2:
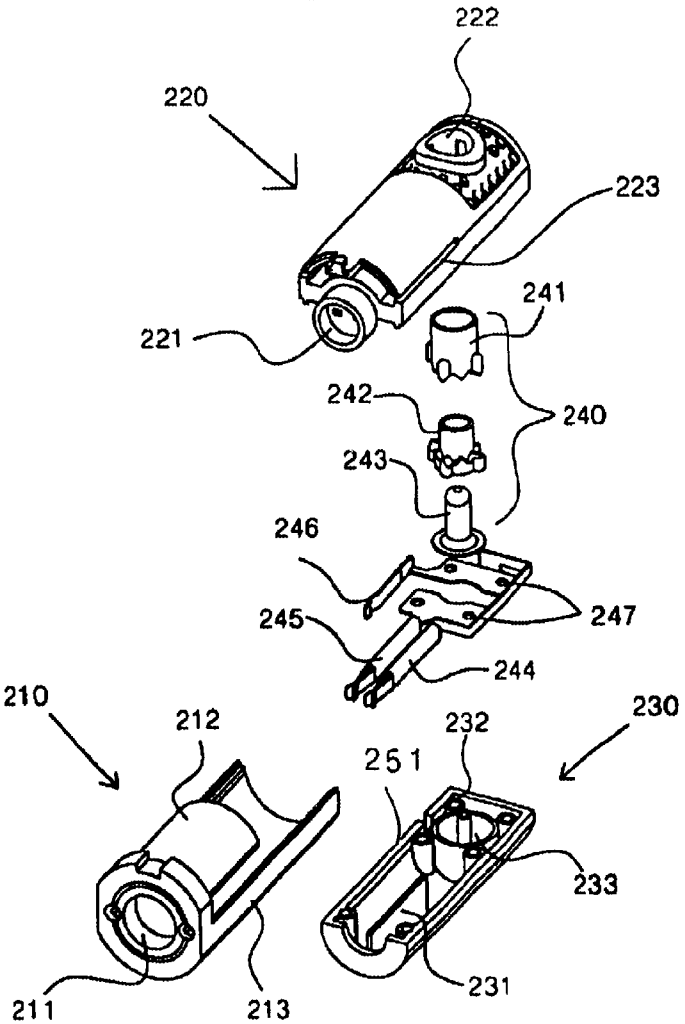
FIG. 2 is a perspective view of a switch main body of FIG. 2.

FIG. 2 is a perspective view of the switch main body 200 that is not assembled, which includes a switch cover 210 in the shape of semi-cylinder and a body part coupled with the switch cover 201.

The switch cover 210 includes a circular securing part 211 to secure a bulb, a semicircular insertion plate 212 that is integrally formed at a rear surface of the securing part, and a protection part 213 that is integrally formed in the shape of semicircular at a lower part of the insertion plate for surrounding the body part.

The body part is composed of an upper body 220 and a lower body 230, wherein a button part 240, positive terminals 244 and 245 and a negative terminal 246 are positioned between the upper and lower bodies. A reference symbol 247 which has not been explained above is a hole that is integrally formed with the positive terminal 245 and the negative terminal 246.

The button part 240 includes button covers 241 and 242 and a button 243.

The upper body 220 is formed with a bulb fixing part 221 to which the bulb is fixed, a hole 222 for inserting the button 243, and cut parts 223 at both sides for inserting and fixing the insertion plate 212 of the switch cover 210.

The lower body 230 is formed with a terminal securing part 231 to which the positive terminals 244 and 245 are fixed, and a plurality of fixing grooves 232 and 233 for fixing the positive terminal 245, the negative terminal 246 and the button 243, wherein the negative terminal is protruded to the outside via a cut part 251 formed at a side of the lower body 230.

Figure 3:
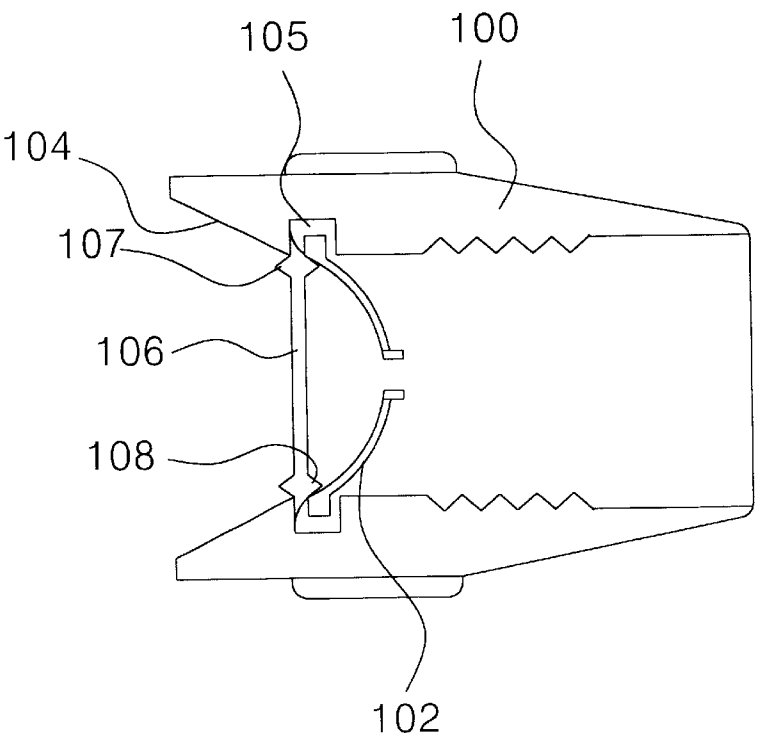
FIG. 3 is a cross-sectional view of an assembled reflection mirror.

FIG. 3 is a cross-sectional view of the head part 100, which is formed with a slant part 104 and a fixing groove 105 at a front surface part.

Further, a lens 106 which is formed with circular protrusions 107 and 108 at both front and rear surfaces, is inserted to the reflection mirror 101, wherein the protrusion 108 of the rear surface closely contact an inside of the reflection mirror 101 and fixed in the reflection mirror. As the reflection mirror 101 coupled with the lens is inserted along the slant part 104 of the head part 100, the reflection mirror 101 is simply inserted and fixed to the fixing groove 105.

In the switch part of the flashlight according to the present invention described as above, the positive terminals 244 and 245 are positioned on the securing part 231 and the negative terminal 246 is positioned outside via the cut opening part 251 at a side of the lower body 230.

The terminal hole 247, which is integrally formed with the positive terminal 245 and the negative terminal 246, is accorded with the fixing groove 232 of the lower body and a nut is inserted into the terminal hole for fixing the terminals in the fixing groove 232, wherein the button 243 is inserted and fixed in the fixing groove 233.

After fitting the button 243 into the covers 242 and 241 in sequence, the upper body 220 is inserted into the lower body 230, so that the button 243 may be protruded and fixed to the outside via the hole 222 of the upper body 220 and the bulb fixing part 221 may be inserted and fixed to the front surface part of the lower body 230.

Therefore, as the upper body 220 and the lower body 230 which are coupled together are fitted in the switch cover 210, the bulb fixing part 221 becomes fitted in the securing part 211 of the switch cover 210 and the insertion plate 212 of the switch cover 210 is inserted and fixed to the cut parts 223 of the upper body 220.

In other words, if the insertion plate 212 is accorded with the cut parts 223 and pushed forward, the insertion plate 212 is inserted into the switch cover 210 along the cut parts 223, so that the upper and lower bodies 220 and 230 may be simply coupled with the switch cover 210 without using any additional coupling elements. At this time, top surfaces of the cut parts 223 becomes lifted upwardly by the insertion plate 212, which serves to fix the switch main body 200 into the case 300 without using any additional fixing element when coupling the switch main body 200 with the case 300.

In the meantime, as the bulb 101 is fitted into the bulb fixing part 221 of the switch main body 200 and the switch main body 200 is inserted into the case 300, the negative terminal of the switch main body 200 contacts the inside of the case 200 and the button 243 becomes movably coupled with the rubber cover via a hole formed at an upper part of the case 300.

The head part 100 is inserted by the reflection mirror 102 and the lens 106, wherein the lens 106 is formed with the protrusions 107 and 108 at both front and rear surfaces, so that the protrusion 108 of the rear surface becomes closely contacting the inside of the reflection mirror 102 when a force is applied to the lens 106 while the lens 106 is accorded with the reflection mirror 102, thereby preventing the vibration of the reflection mirror and waterproofing the reflection mirror.

When the reflection 102 that is coupled with the lens is inserted into the head part 100, the reflection mirror 102 is simply inserted into the head part 100 along the slant part 104 formed at the front surface of the head part 100, so that the reflection mirror 102 is fixed into the fixing groove 105. Once the reflection mirror 102 is fixed into the fixing groove 105 of the head part 100, the reflection mirror is not deviated from the fixing groove.

The protrusion 107 formed on the front surface of the lens 106 is pushed when the lens 106 is inserted into the head part 100, so that the lens 106 is inserted into the head part 100 without touching the lens part itself at all, thereby protecting the lens 106.

After that, the batteries are inserted from the rear surface of the case 300 and the lid 400 is coupled with the case. Then, the spring 401 which is elastically mounted to the lid 400 elastically fixes the batteries in the case 300, wherein the power is supplied to the batteries of the bulb 101 by pressing the button 243.

As described hereinabove, according to the present invention, the cover of the switch main body is integrally formed with a semicircular insertion plate and the upper body is formed with cut parts, so that the insertion plate is inserted to the cut parts when assembling the switch main body. Therefore, the switch main body may be simply assembled without using any additional tools. Further, the insertion plate pushes the cut parts upwardly, so that the switch main body is firm fixed in the case.

Furthermore, according to the present invention, the lens is fixed in the reflection mirror of the head part in contact with the inside of the reflection mirror, thereby obtaining the vibration prevention and the waterproofing.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A flash light, comprising:

a case, a main switch operably disposed within said case, a head part removably attached to said case at one end thereof and having a light bulb therein, said main switch further comprising an upper body and a lower body securable to said upper body, a button part operably disposed between said upper and lower bodies, a switch cover comprising a bulb securing part, an insertion plate, and a lower protecting part, said switch cover is securable between said upper and lower bodies, said main switch further comprises a long negative terminal contacting the switch cover, and a lid having a spring and removable attached to said case for compressing and securing a plurality of batteries inside said case.

2. A flashlight according to claim 1, wherein said upper body further comprises longitudinal cut parts and wherein said insertion plate of said switch cover is received within said cut parts of said upper body.

3. A flashlight according to claim 1, further comprising a reflection mirror and a lens disposed within said head part.

4. A flashlight according to claim 3, wherein said lens further includes a circular protrusion configured and dimensioned to contact an inner side of said reflection mirror.

* * * * *